US007997115B2

(12) United States Patent
Tidl et al.

(10) Patent No.: US 7,997,115 B2
(45) Date of Patent: Aug. 16, 2011

(54) FOLDING DEVICE FOR A BENDING PRESS, IN PARTICULAR AN EDGING PRESS

(75) Inventors: Martin Tidl, Linz (AT); Heinz Leumüller, Linz (AT)

(73) Assignee: Trumpf Maschinen Austria GmbH & Co. KG, Pasching (AT)

( * ) Notice: Subject to any disclaimer, the term of this patent is extended or adjusted under 35 U.S.C. 154(b) by 282 days.

(21) Appl. No.: 12/388,279

(22) Filed: Feb. 18, 2009

(65) Prior Publication Data

US 2010/0018283 A1 Jan. 28, 2010

(30) Foreign Application Priority Data

Feb. 19, 2008 (AT) ..... A 267/2008

(51) Int. Cl.
*B21D 17/02* (2006.01)
*B21J 7/46* (2006.01)
*B41F 13/00* (2006.01)

(52) U.S. Cl. ..... 72/384; 72/389.3; 72/413; 72/472; 72/477; 72/481.1

(58) Field of Classification Search ..... 72/384, 72/389.1, 389.3, 413, 472, 477, 481.1
See application file for complete search history.

(56) References Cited

U.S. PATENT DOCUMENTS

| | | | | | |
|---|---|---|---|---|---|
| 3,681,994 | A | * | 8/1972 | Zbornik | 72/389.3 |
| 3,845,655 | A | * | 11/1974 | Krieg | 72/389.3 |
| 4,509,357 | A | * | 4/1985 | Zbornik | 72/384 |
| 4,691,553 | A | * | 9/1987 | Barber | 72/444 |
| 4,805,438 | A | * | 2/1989 | Ginn et al. | 72/384 |
| 4,852,379 | A | * | 8/1989 | Levenberg | 72/384 |

FOREIGN PATENT DOCUMENTS

| | | | |
|---|---|---|---|
| DE | 26 52 886 | A1 | 5/1978 |
| DE | 43 15 706 | A1 | 11/1994 |
| DE | 44 25 992 | A1 | 1/1996 |
| EP | 0 096 211 | A1 | 12/1983 |
| EP | 0 624 411 | A1 | 11/1994 |
| JP | 61-176422 | A | 8/1996 |

* cited by examiner

*Primary Examiner* — David B Jones
(74) *Attorney, Agent, or Firm* — Alston & Bird LLP

(57) ABSTRACT

The invention relates to a folding device (1) for a bending press, in particular an edging press for a 180°-folding brace on a workpiece (2) with a forming die (3) comprising a V-groove and a forming stamp (4) adjustable thereto and comprising a wedge extension (26) and with a folding die (5) arranged adjacent to the forming die (3) and forming a support surface (33) in a plane (23) extending perpendicular to an adjustment direction of the forming stamp (4). A tool mount (7) with the forming die (3) and the folding die (5) is arranged adjustably on an upper side (18) of a table beam (9), in a direction perpendicular to a bending plane (22), forming a gap (27) for mounting the wedge extension (26) for the folding procedure.

22 Claims, 5 Drawing Sheets

FOLDING DEVICE FOR A BENDING PRESS, IN PARTICULAR AN EDGING PRESS

BACKGROUND OF THE INVENTION

1. Field of the Invention

The invention relates to a folding device for a bending press, for forming a 180°-folding brace from a sheet metal workpiece.

2. Prior Art

To form a 180°-folding brace on a prefolded sheet-metal workpiece a folding device for a bending press, in particular an edging press, is known in which a lower forming die secured in a fixed table beam of the bending press, in a plane running perpendicular to an adjusting direction of an upper forming stamp secured in an adjustable press beam, comprises a support surface for placing down the prefolded workpiece. The adjustable forming stamp with a strip-like shoulder forms a stamping surface covering the support surface, and the final bending of the 180°-folding brace is performed after placing the workpiece onto the support surface of the forming die between the latter and the stamping surface of the adjustable forming stamp.

OBJECTIVES AND ADVANTAGES OF THE INVENTION

The objective of the invention is to create a folding device, by means of which in sequential operations the prefolding of a sheet-metal workpiece and subsequent final bending to form a 180°-folding brace is achieved without involving a complex tool change or refitting process.

The objective of the invention is achieved by configuring the folding device such that between facing side faces of the forming die and the folding die a gap is formed for mounting a wedge extension of the forming stamp by a spacing measured perpendicular to the bending plane. The surprising advantage is that the processing steps, folding to form an angularly projecting leg on the workpiece and final bending to form a 180°-folding brace, are achieved in consecutive stages without requiring intermediate storage, thus achieving a reduction in the manipulation time and a reduction of the cycle time.

One embodiment described herein allows the use of a forming stamp provided with a measuring device, a so-called sensing disc, whereby, one the one hand, a high degree of precision of the bending angle for the prefolding is achieved and, on the other hand, in such a case by means of the recesses required in the forming die by folding on the recesses stamp marks are effectively prevented on the workpiece.

Advantageous configurations are described in which movement of the forming stamp into an immersion slot in the folding die causes a pivoting of a twin-arm lever element, which pivoting in turn causes an adjustment movement, that is directly dependent on the adjustment movement of the forming stamp, of a slide element such that the slide element is moved so as to bridge the immersion slot, such that an additional driving device for such a slide element is unnecessary.

Advantageous developments of the slide element are described, by means of which the bending force acting on the workpiece is effectively absorbed and a high quality 180°-folding brace is obtained.

According to a further advantageous embodiment described, a rapid adjustment of the positions of the tool mount with the forming die and the folding die is achieved in different tool configurations.

An embodiment is also described wherein a stop surface for the workpiece defined precisely in relation to the stamping surface is achieved.

In embodiments described herein, a sufficient adjustment movement of the forming stamp is made for adjusting the slide element to cover the immersion slot prior to the action of the stamping surface on the workpiece.

According to an advantageous embodiment described, the loading of the pivot bearing arrangement of the twin-arm pivot lever is low.

Also described is an embodiment in which the function of the slide element is ensured even with the appearance of deposits in the mounting chamber of the twin-arm lever element.

Lastly, an embodiment is described whereby a structurally simple end stop is obtained for delimiting the adjustment movement of the slide element and supporting the spring force acting on the twin-arm lever element.

BRIEF DESCRIPTION OF THE FIGURES

For a better understanding of the invention the latter is explained in more detail with reference to the exemplary embodiments shown in the Figures.

DETAILED DESCRIPTION OF PREFERRED EMBODIMENTS

Figure 1:
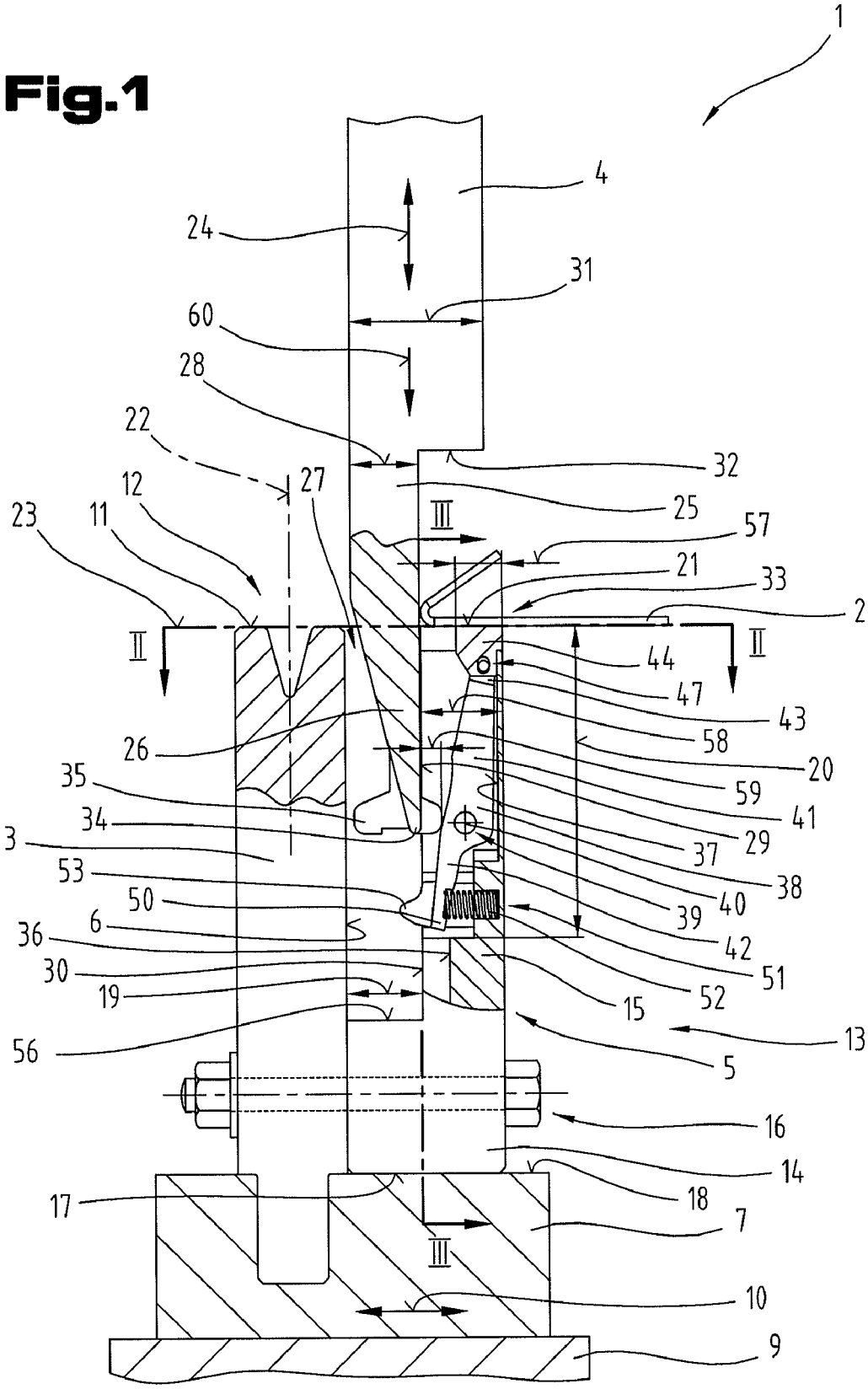
FIG. 1 shows an embodiment of the folding device according to the invention with a wedge extension of a forming stamp projecting partly into a gap between a forming die and a folding, partly in cross section.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Figure 2:
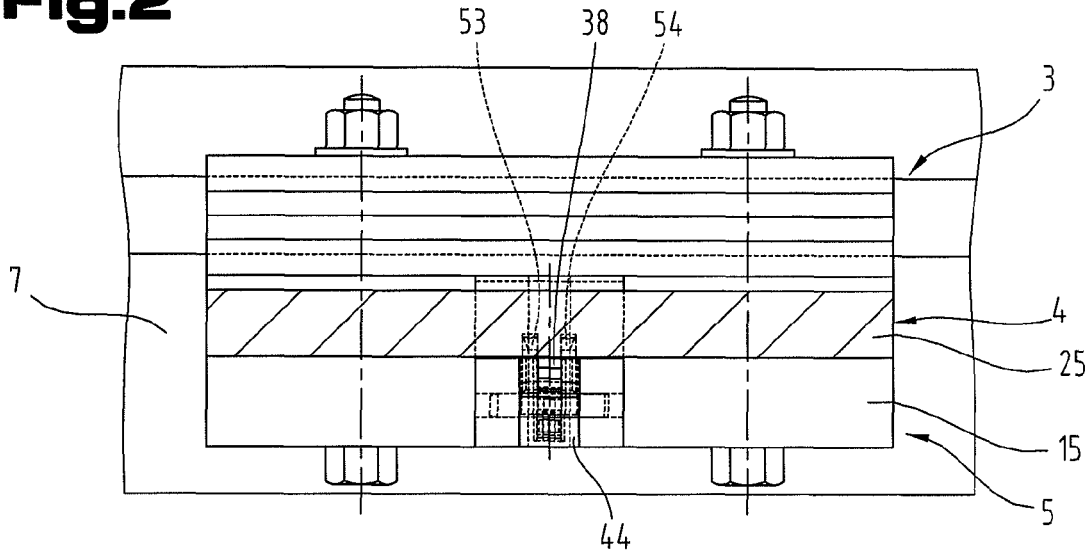
FIG. 2 shows the folding device partly in cross section along the lines II-II in FIG. 1.
Figure 3:
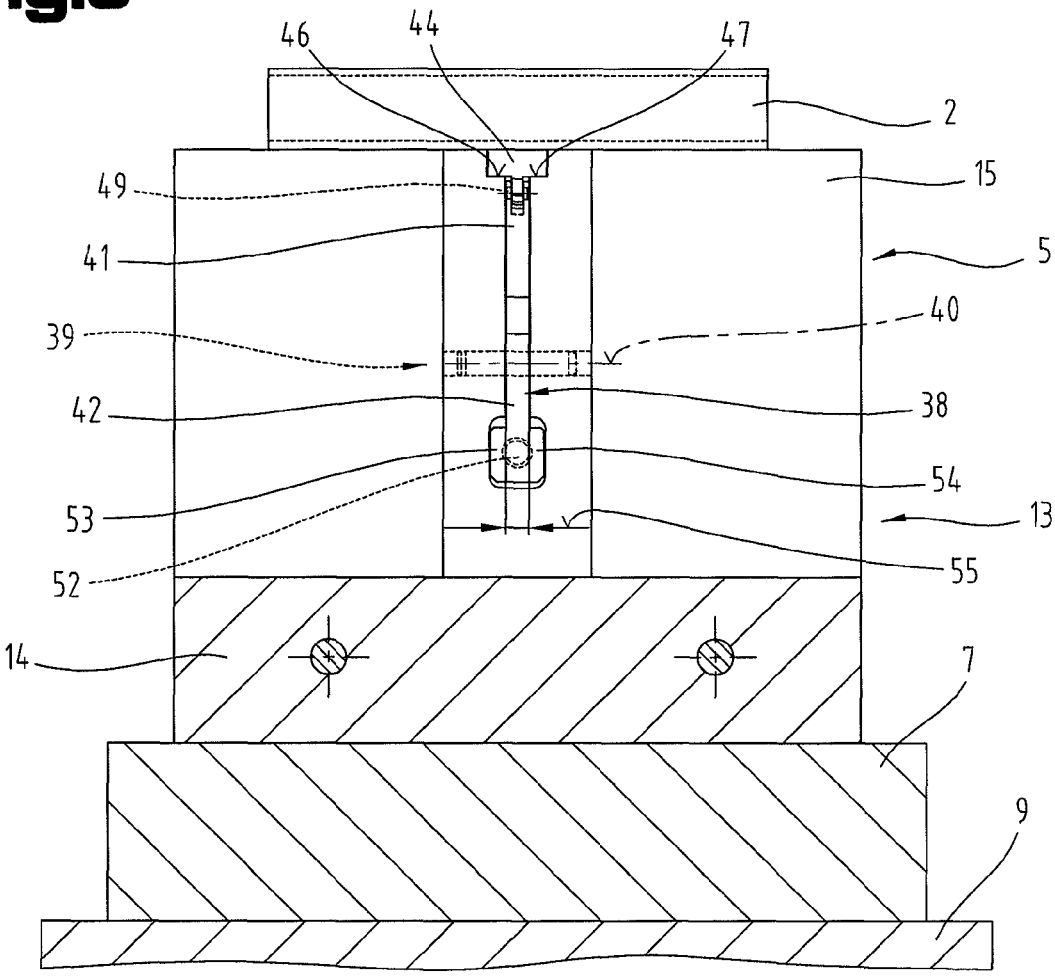
FIG. 3 shows the folding device partly in cross section along the lines in FIG. 1.

FIGS. 1 to 3 show a folding device 1 for producing a 180° folding brace on a sheet metal workpiece 2 between a fixed forming die 3 and an adjustable forming stamp 4 and a folding die 5, of a bending press that is not shown in more detail.

The forming die 3 with the folding die 5, which is preferably attached to a side face 6 of the forming die 3, is secured into a tool mount 7, a so-called tool batten, by means of a standard tensioning strip 8 and not shown tensioning devices known from the prior art. The tool mount 7 is mounted adjustably by means of an adjusting device on an upper side of a table beam 9 of the bending press—according to double arrow 10.

The adjusting device is for example a hydraulic drive, electric drive etc. and the adjustment is performed for example manually against predefined stops or via a program-controlled machine control.

The forming die 3 has on an end face 11 opposite the tensioning strip 8 a V-groove 12 for prefolding the workpiece to a predefined angle, e.g. less than 90°.

The folding die 5 is formed by an L-shaped base body 13 with a base leg 14 and a leg 15 extending parallel to the forming die 3, and in addition to securing to the forming die 3, e.g. screws 16, is supported by a base surface 17 of the base leg 14 on an upper side 18 of the tool mount 7. The leg 15 extending from the base leg 14 parallel to the forming die and at a spacing 19 from the side face 6 of the forming die 3 has a height 20, whereby an end face 21 of the leg 15 opposite the base surface 17 is aligned with the end face 11 of the forming die 3 in a common plane 23 extending perpendicular to a bending plane 22.

FIG. 1 shows the position of the forming die 3 with the folding die 5, in which the forming stamp 4 on adjustment according to a double arrow 24 with a strip-like shoulder 25 and a projecting wedge extension 26 projects into a gap 27 formed by the spacing 19 of the leg 15 from the side face 6 of the forming die 3. A thickness 28 of the strip-like shoulder 25 is slightly smaller than the spacing 19. The shoulder 25 and the wedge extension 26 form a common plane side face 29, which is aligned with the smallest gap formation with a side face 30 of the leg 15 opposite the side face 6 of the forming die 3.

The total thickness 31 of a tensioning head of the forming stamp 4 is greater than the thickness 28 of the strip-like shoulder 25, whereby a stamping surface 32 extending in a perpendicular plane relative to the side face 29 is formed on the forming stamp 4, which stamping surface with a suitable position of the forming stamp 4 for the final bending of the folding brace on the workpiece 2 cooperates with a support surface 33 formed by the end face 21 of the leg 15.

In the wedge extension 26, as shown in the region of a wedge point 34 and projecting over the latter laterally, at least one sensing disc 35 is arranged as a sensing element of an angle measuring device known from the prior art for the folding procedure.

By means of the lateral projection of the sensing disc 35 in the leg 15 there is an immersion slot 36 running from the support surface 33 and interrupting the latter and extending in the direction of the base leg 14, whereby the wedge extension 26 with the projecting sensing disc 35 can be moved in an adjustment—according to double arrow 24—of the forming stamps 4 into the gap 27, before placing the workpiece 2 onto the support surface 33.

In addition to the immersion slot 36 in the leg 15 a slot-like mounting chamber 37 is formed which widens the immersion slot 36. In the latter a twin-arm lever element 38 in a pivot bearing arrangement 39 is mounted pivotably about a pivot axis 40 in an adjustment plane extending perpendicular to the side face 29 of the wedge extension 26, whereby the pivot axis 40 runs parallel to the base surface 17 of the base body 13.

From the pivot axis 40 a lever arm 41 of the twin-arm lever element 38 extends in the immersion slot 36 in the direction of the support surface 33 and a further lever arm 42 in the direction of the base surface 17. In an end section 43 the lever arm 41 is connected joint-like with a slide element 44, which is displaceably mounted in a guiding arrangement 45, formed by guiding tracks 46, 47 running perpendicularly to the side face 30 on both sides of the immersion slot 36 in the leg 15. A joint connection 48 between the lever arm 41 and the slide element 44 is formed by a bolt 49 between a fork formation of the lever arm 41 and a bearing extension of the slide element 44. The joint connection 48 ensures a precise linear displacement of the slide element 44 on a pivot movement of the twin-arm lever element 38 in that e.g. the bearing extension of the slide element 44 passed through by a bolt 49 comprises an elongated hole.

The additional lever arm 42 is pretensioned on an end section 50 facing the base surface 17 by a spring arrangement 51, e.g. a helical compression spring, in the direction of the side face 30 of the leg 15 and in the end section 50 preferably has two adjusting cams 53, 54, which project in the position of the lever arm 42 pretensioned by the helical compression spring 52 over the side face 30 of the leg 15, i.e. into the gap 27. This position is ensured by a stop surface of the leg 15 for the lever arm 41 that is drive-connected with the slide element 44.

The arrangement of the adjusting cams 53, 54 on the lever arm 42 is such that a spacing 55 between the adjusting cams 53, 54 allows the movement of the sensing disc 35 through the adjusting cams 53, 54 on an adjustment of the wedge extension 26 in the direction of the base surface 17 or an upper side 56 of the base leg 14 delimiting the gap 27.

The slide element 44 connected in movement with the lever arm 41 has a width 57 measured in adjustment direction, which corresponds approximately to the thickness 58 of the leg 15 minus the projection 59 of the sensing disc 35, by which the latter projects over the side face 29 of the wedge extension 26.

In the position of the twin-arm lever element 38 pretensioned by the helical compression spring 52 the slide element 44 is in a position remote from the side face 29 of the wedge extension 26, whereby the immersion slot 36 is freed for allowing the sensing disc 35 to move therethrough.

As soon as during an adjustment of the forming stamp 4 with the wedge extension 26—according to arrow 60—the wedge point 34 acts on the adjusting cams 53, 54 projecting into the gap 27, a pivoting of the twin-arm lever element 38 occurs against the action of the spring force of the helical compression spring 52 and in this way an adjustment of the slide element 44 into a front end position facing the side face 29 of the wedge extension 26 occurs, in which the immersion slot 36 is covered by the slide element 44 and the slide element thus forms an area of the support surface 33.

In this way stamp marks on the workpiece 2 caused by folding on the immersion slot 36 during the final bending of the prefolded workpiece 2 and the production of the 180°-folding brace are effectively prevented, which would otherwise be created when the forming stamp 4 applies its forming force.

As already mentioned, FIG. 1 shows a position of the forming stamp 4 in which the wedge extension 26 protrudes partly into the gap 27, but the wedge point 34 has not yet acted on the adjusting cams 53, 54.

In this position during the further adjustment movement of the forming stamp 4 the prefolded workpiece 2 can be placed for subsequent operations on the support surface 33 of the folding die 5, whereby the side face 29 of the wedge extension 26 forms a bearing surface for the workpiece 2.

With the further adjustment of the forming stamp 4—according to arrow 60—before the stamping surface 32 contacts the workpiece 2, there is a pivoting of the twin-arm lever element 38 by the action of the wedge point 34 on the adjusting cams 53, 54 and thus the adjustment of the slide element 44 into one of the side faces 29 of the wedge extension 26 to the end position facing the forming stamp 4, and in this way the immersion slot 36 is covered and a continuous support surface 33 is obtained.

Figure 4:
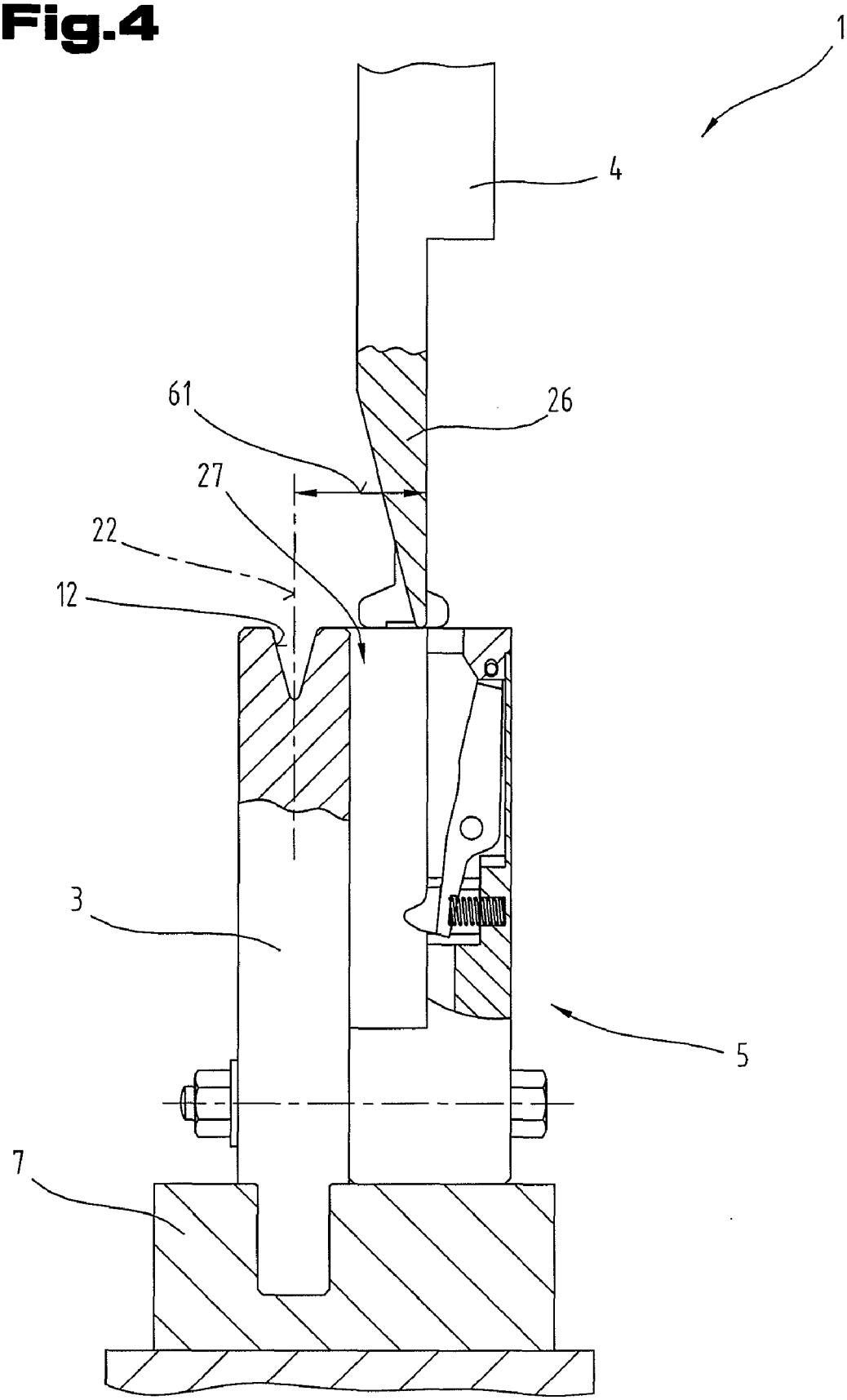
FIG. 4 shows the folding device according to the invention in the position of the wedge extension of the forming stamp prior to immersion into the gap.

After a reverse movement of the forming stamp 4 the slide element 44 is restored into an end position remote from the side face 29 of the wedge extension 26, whereby the immersion slot 36 is released and the forming stamp 4 is moved completely out of the gap 27, as shown in FIG. 4.

To perform a further prefolding procedure the tool mount 7 on the table beam 9 is adjusted into the corresponding position for the folding process by a distance 61 in which the forming die 3 with the V-groove 12 and the wedge extension 36 are aligned opposite one another in the bending plane 22.

In this way a directly sequential implementation of the stages of prefolding and final bending to produce the 180°-folding brace is possible with the use of the forming stamp 4 equipped with the sensing disc 35 in connection with the folding die 5, as already described in detail, and thus the intermediate positioning of prefolded workpieces 2 before the final bending process is unnecessary, thus reducing the cycle time, as the adjustment process of the tool mount 7—according to double arrow 10—takes up less time than the interim putting down and picking up of the workpiece 2.

Figure 5:
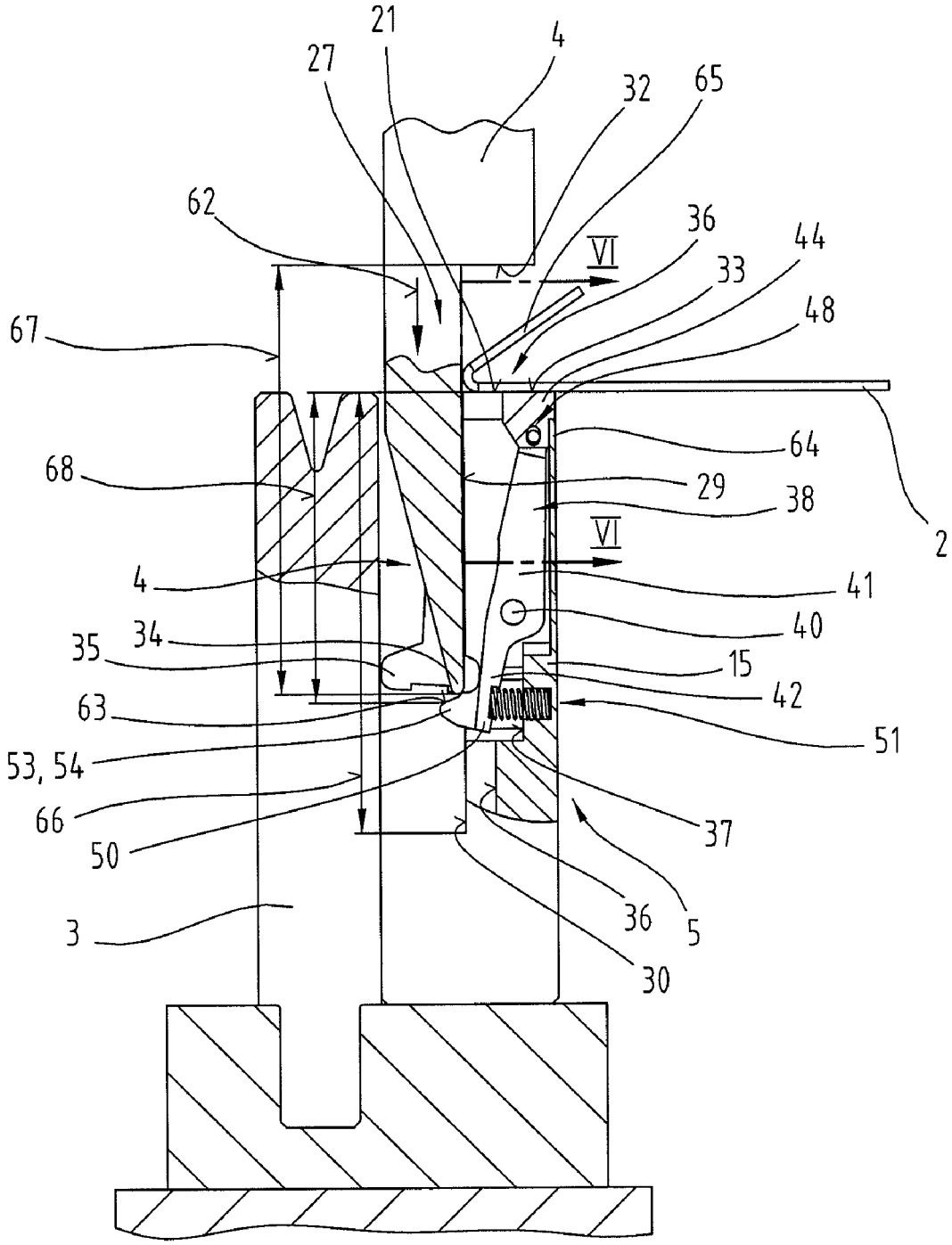
FIG. 5 shows a further embodiment of the folding device with the wedge extension of the forming stamp in a position showing the action of the wedge extension on adjusting cams of a twin-arm lever element drive-connected to a slide element.

FIG. 5 shows the position of the wedge extension 26 in the gap 27 between the forming die 3 and the leg 15 of the folding die 5. In this position the wedge point 34 begins to act on the adjusting cams 53, 54 of the lever arm 42 upon an adjustment according to arrow 62. An upper side 63 of the adjusting cams 53, 54 facing the wedge point 34 is in the form of a curved slide, thus achieving a sliding leading and adjustment of the lever arm 42 against the action of the spring arrangement 51 by the whole projection, by which the adjusting cams 53, 54 project over the side face 30 of the leg 15. There is thus an adjustment of the slide element 44 forming the support surface 33, which slide element is articulated onto the additional lever arm 41 in the joint connection 48, from the shown end position on a rear wall web 64 of the leg 15 to an end position in which the slide element 44 bears on the side face 29 of the wedge extension 26 and bridges the immersion slot 36 of the leg 15. In this way on the end face 21 of the leg 15 the continuous support surface 33 is obtained and with a further adjustment of the wedge extension 26—according to arrow 62—the 180°-folding brace is completed by the action of the stamping surface 32 of the forming stamp 4 on an angularly protruding leg 65 of the workpiece 2.

The depth 66 of the immersion slot 36 is about the same as the height 20 of the leg 15 and is greater than the length 67 of the wedge extension 26 measured in vertical direction between the stamping surface 32 and the wedge point 34. A distance 68 measured in vertical direction between the support surface 33 or end face 21 of the leg 15 and the adjusting cams 53, 54 is smaller than the length 67 of the wedge extension 26.

Figure 6:
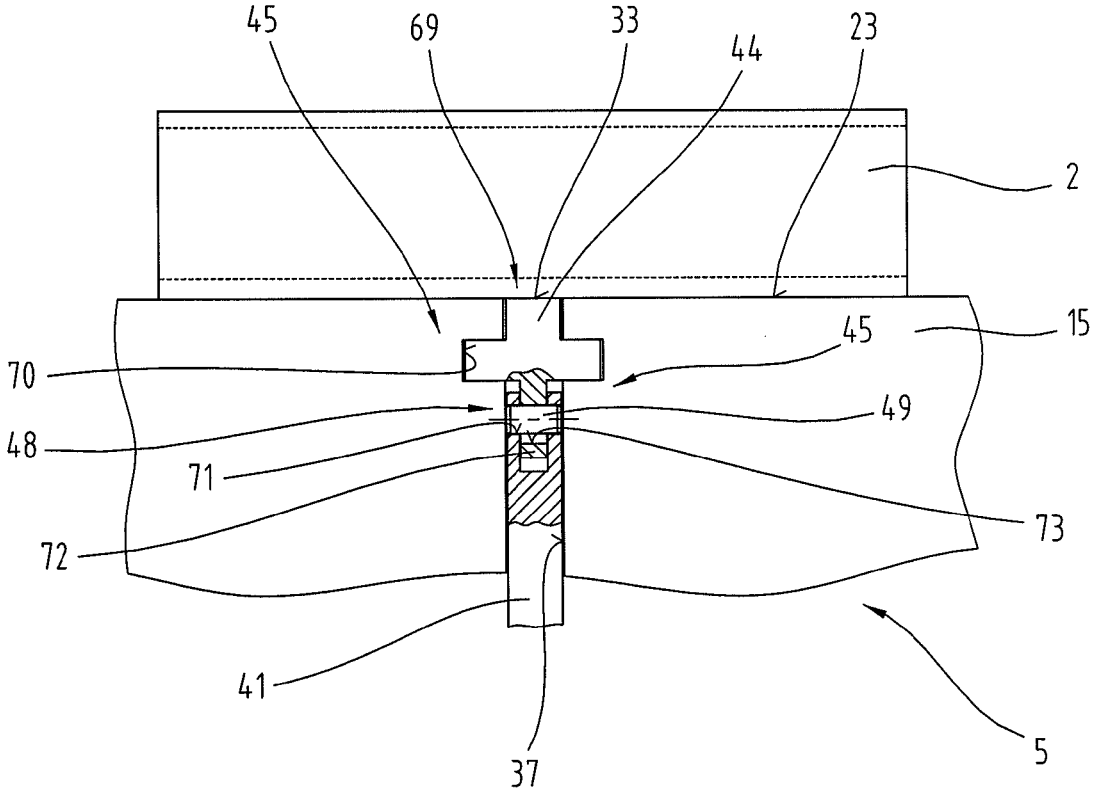
FIG. 6 shows a view of the folding device according to the arrows VI-VI in FIG. 5, partly in cross section.

FIG. 6 shows another embodiment of the slide element 44 forming the support surface 33, in which the slide element is in the form of a T-nut 69 and guiding grooves 70 forming the guiding arrangement 45 are made on both sides of the immersion slot 36 or side faces of the gap 37. As also shown in the drawing the joint connection 48 between the lever arm 41 and the slide element 44 is formed by the fork-like lever arm 41, the bolt 49, which crosses the fork-like lever arm 41 in bores 71 and a bearing tab 72 of the slide element 44 in an elongated hole 73. In this way an adjustment is made between the linear movement of the slide element 44 and the pivot movement of the lever arm 41.

The exemplary embodiments show possible embodiment variants of the folding device, whereby it should be noted at this point that the invention is not restricted to the embodiment variants shown in particular, but rather within the scope of the claims various different combinations of the individual embodiment variants are possible. Thus within the scope of the claims all conceivable embodiment variants, which are made possible by combining individual details of the embodiment variants shown and described, are also covered by the scope of protection.

As a point of formality, it should be noted finally that for a better understanding of the structure of the folding device the latter and its components have not been represented to scale in part and/or have been enlarged and/or reduced in size.

The underlying problem of the independent solutions according to the invention can be taken from the description.

The invention claimed is:

1. A folding device for a bending press for forming a 180°-folding brace from a sheet metal workpiece, the folding device comprising:

a forming die comprising a V-groove and a forming stamp that is adjustable relative thereto, the forming stamp defining a wedge extension;

a folding die arranged adjacent to the forming die, the folding die defining a support surface in a plane extending perpendicular to an adjustment direction of the forming stamp, wherein a gap is defined between facing side faces of the forming die and the folding die, the gap defining a spacing measured perpendicular to a bending plane of the folding device;

a tool mount for the forming die and the folding die, the tool mount being arranged in adjustable manner on an upper side of a table beam in a direction perpendicular to the bending plane such that the tool mount is movable between a pre-forming position in which the forming die is positioned to receive the wedge extension of the forming stamp in the V-groove of the forming die, and a folding position in which the gap is aligned with the wedge extension of the forming stamp;

the support surface being arranged to support a sheet metal workpiece thereon, the forming stamp and the forming die cooperating to pre-form the workpiece when the tool mount is in the pre-forming position, the tool mount then being moved to the folding position and the forming stamp and folding die cooperating to form the pre-formed workpiece into a 180°-folding brace.

2. The folding device according to claim 1, wherein a side of the folding die facing the forming die defines an immersion slot extending from the support surface in the adjustment direction of the forming stamp, and further comprising a slide element arranged adjustably so as to covering the immersion slot, a surface of the slide element forming at least one section of the support surface, the slide element being movable in a guiding arrangement of the folding die.

3. The folding device according to claim 2, characterized in that the folding die is formed by a substantially L-shaped base body, which is secured by a base leg onto the side face of the forming die and is supported by a base surface on an upper side of the tool mount.

4. The folding device according to claim 3, characterized in that an additional leg of the base body is aligned to extend in parallel and in the spacing to the side face of the forming die.

5. The folding device according to claim 1, characterized in that the spacing is slightly larger than a thickness of a shoulder for the wedge extension of the forming stamp.

6. The folding device according to claim 3, further comprising a twin-arm lever element mounted in a pivot bearing arrangement and disposed in the immersion slot, the twin-arm lever element being pivotable in an adjusting plane extending perpendicular to the bending plane about a pivot axis.

7. The folding device according to claim 6, characterized in that an upper lever arm of the twin-arm lever element projecting from the pivot axis in the direction of the support surface is connected at an end section to the slide element via a joint connection.

8. The folding device according to claim 6, characterized in that a lower lever arm of the twin-arm lever element projecting from the pivot axis in the direction of the base leg is provided in an end section with two adjusting cams, separated by a slot.

9. The folding device according to claim 8, characterized in that the lower lever arm comprising the adjusting cams is pretensioned in the end section by a spring element of a spring arrangement in the direction of the forming die.

10. The folding device according to claim 9, characterized in that in a spring-loaded end position of the twin-arm lever element the adjusting cams project over the side face of the leg of the folding die facing the side face of the forming die.

11. The folding device according to claim 10, characterized in that in the spring-loaded end position of the twin-arm lever element the slide element is positioned against a stop on a rear wall web, of the leg such that the slide element uncovers the immersion slot.

12. The folding device according to claim 2, characterized in that the slide element has a substantially T-shaped cross section.

13. The folding device according to claim 2, characterized in that the slide element is designed in the form of a slot nut.

14. The folding device according to claim 2, characterized in that the guiding arrangement is formed by guiding tracks extending on both sides of the immersion slot.

15. The folding device according to claim 2, characterized in that the guiding arrangement is formed by guiding grooves extending on both sides of the immersion slot.

16. The folding device according to claim 1, wherein when the tool mount is in the folding position the gap is located such that the wedge extension is movable into the gap.

17. The folding device according to claim 8, characterized in that a clamping head of the forming stamp in a plane extending perpendicular to a planar side face of the wedge extension has a stamping surface cooperating with the support surface of the folding die.

18. The folding device according to claim 17, characterized in that a length measured from the stamping surface to a wedge point of the wedge extension is smaller than a depth of a gap between the forming stamp and the leg of the base body.

19. The folding device according to claim 18, characterized in that the length of the wedge extension is greater than a distance of the adjusting cams from the support surface.

20. The folding device according to claim 8, characterized in that an upper side of the adjusting cams facing the wedge extension is designed to be curved.

21. The folding device according to claim 8, characterized in that a projection of the adjusting cams projecting over the side face of the leg is smaller than an adjustment movement of the lever arm with the adjusting cams.

22. The folding device according to claim 6, characterized in that the leg of the folding die defines a mounting chamber accommodating the twin-arm lever element, a rear wall web of the leg delimiting the mounting chamber and forming a stop for the slide element in a position spaced apart from the forming die.

* * * * *

UNITED STATES PATENT AND TRADEMARK OFFICE

CERTIFICATE OF CORRECTION

PATENT NO. : 7,997,115 B2
APPLICATION NO. : 12/388279
DATED : August 16, 2011
INVENTOR(S) : Tidl et al.

It is certified that error appears in the above-identified patent and that said Letters Patent is hereby corrected as shown below:

Column 2
Line 33, “the lines in” should read --the lines III-III in--.

Column 6
Line 59, “to covering the” should read --to cover the--.

Signed and Sealed this
Twenty-fifth Day of September, 2012

David J. Kappos

David J. Kappos
*Director of the United States Patent and Trademark Office*